United States Patent [19]

Grandcolas et al.

[11] 4,338,080

[45] Jul. 6, 1982

[54] SEAL ASSEMBLY FOR A ROTARY KILN

[75] Inventors: Jean Grandcolas, Marseilles; Guy Harmelin, Martigues; Roger Lazzarini, Marseilles; Bernard Reverchon, Bouc Bel Air, all of France

[73] Assignee: Lafarge Conseils et Etudes, Paris, France

[21] Appl. No.: 220,169

[22] Filed: Dec. 23, 1980

[30] Foreign Application Priority Data

Dec. 24, 1979 [FR] France ..... 79 31603

[51] Int. Cl.[3] ..... F27B 7/24; F27D 1/18; F26B 25/00

[52] U.S. Cl. ..... 432/115; 34/242; 432/242

[58] Field of Search ..... 432/115, 242; 34/242

[56] References Cited

U.S. PATENT DOCUMENTS 3,016,236 1/1962 Alonso ..... 432/115

3,575,397 4/1971 McDowell ..... 432/115

3,940,239 2/1976 Rossi et al. ..... 432/115

FOREIGN PATENT DOCUMENTS 508310 12/1979 U.S.S.R. ..... 432/115

*Primary Examiner*—John J. Camby

*Attorney, Agent, or Firm*—Frost & Jacobs

[57] ABSTRACT

A seal assembly is disclosed for a rotary kiln such as those used in cement manufacture. The seal assembly is interposed between a first part rotating with the rotating cylinder of the kiln and a second, stationary part having a cylindrical surface coaxial with the rotating cylinder. The seal assembly comprises an annular array of graphite elements in rubbing contact with the cylindrical surface and generally radial sides having overlapping rabbets restricting flow of gas between adjacent elements, and a flexible clamping cable or the like bearing against the outer surfaces of the graphite elements for clamping them against the cylindrical surface.

4 Claims, 4 Drawing Figures

SEAL ASSEMBLY FOR A ROTARY KILN

BACKGROUND OF THE INVENTION

The present invention relates to a seal assembly for a rotary kiln.

Industrial rotary kilns are typically of huge size, up to 100 meters long or more, with a diameter of several meters. Elevated temperatures considerably in excess of 1000° C. are attained therein. The most frequent uses of such kilns are in large cement-manufacturing plants.

Fluidtightness at the ends of the rotating parts of such kilns poses difficult problems, especially at the hotter, lower end. Indeed, it is not only necessary to take into account the temperature conditions at the seal which limits the choice of materials but also considerable displacements due to the expansion of the entire kiln, the atmosphere which is often corrosive and abrasive due to the entrained dust, pressure variations in the kiln which alternately tend to cause discharge of hot gases and intake of air, the phenomena all being detrimental and the main cause of loss of heat.

Heretofore proposed solutions to these problems have been imperfect and failing perfect fluidtightness, one has had to content oneself with limiting the intake of air and hot gas leaks by providing play as small as possible between the rotating and stationary parts.

It has, however, been proposed to eliminate insofar as possible, air intake and gas leaks by using graphite blocks which are maintained by a stationary part and rub constantly against the rotating part. The graphite has good high temperature resistance and a low coefficient of friction.

For example French patent no. 1,438,392 provides a liner formed of a plurality of graphite blocks. Each graphite block is provided with its own force-applying means including a spring, pivots and other elements. But given the great number of graphite blocks employed in practice (e.g. 70) the likelihood of mechanical failure is relatively high.

SUMMARY OF THE INVENTION

According to the invention there is provided a seal assembly in a rotary kiln of the type having a rotating cylinder, a first part fixed for rotation with the rotating cylinder and a second, stationary part having a cylindrical surface coaxial of the rotating cylinder, the seal assembly being interposed between the first and second parts. The seal assembly is characterized by a liner disposed outwardly of the cylindrical surface in rubbing contact therewith and including an annular array of graphite elements or plates in contact with one another along generally radial surfaces, and by a tensioned elongate flexible clamping means bearing against the outer surfaces the graphite elements or plates and clamping the graphite elements or plates against the aforesaid cylindrical surface.

Preferably, the graphite elements or plates mutually overlap each other to prevent any possible leaking of gas.

Preferably, the flexible clamping means is a chain or cable. Advantageously the flexible clamping means is tensioned by a counterweight. Alternatively the flexible clamping means is tensioned by spring means or jacks.

The present invention will now be described in greater detail with reference to a preferred embodiment illustrated in the accompanying drawings.

DETAILED DESCRIPTION OF THE PREFERRED EMBODIMENT

Figure 1:
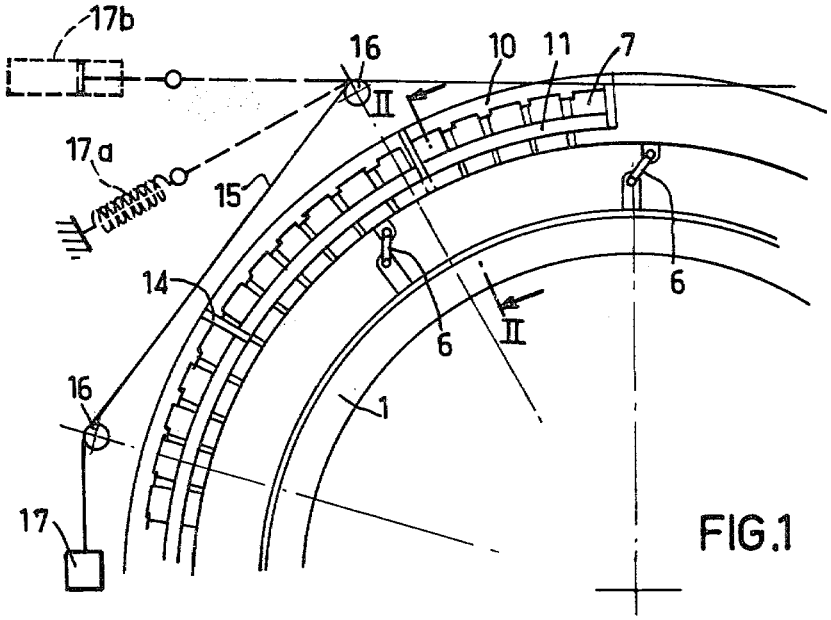
FIG. 1 shows a fragmentary view of the seal assembly embodying the invention taken in a direction perpendicular to the axis of the rotary kiln.

In the drawings the cylinder 1 of the rotary kiln is extended by a part known as a nose ring 2.

The nose ring 2 is cooled by flow of air (arrows 3) channeled by a cylindrical-conical cowling 4.

A first, cylindrical part 5, of steel, concentric to the cylinder of the rotary kiln, comprises the rotating part with which the seal assembly is associated. The first, cylindrical part 5 is carried by a plurality of links 6 mounted on the cylinder 1 of the rotary kiln to retain the cylindrical configuration of this cylindrical part 5 and its concentricity with respect to the axis of the rotary kiln even when its temperature is very much less than that of the cylinder 1 of the rotary kiln. The cylindrical part 5 is further sealingly connected to the cowling 4, the shifting or displacement corresponding to the accommodation to maintain concentricity and differential expansion being taken up by a flexible interconnection 4*a* between parts 4 and 5. The outer surface of part 5 is smooth over a length greater than the range of positions of the end of the rotary kiln in response to variations in temperature.

Figure 4:
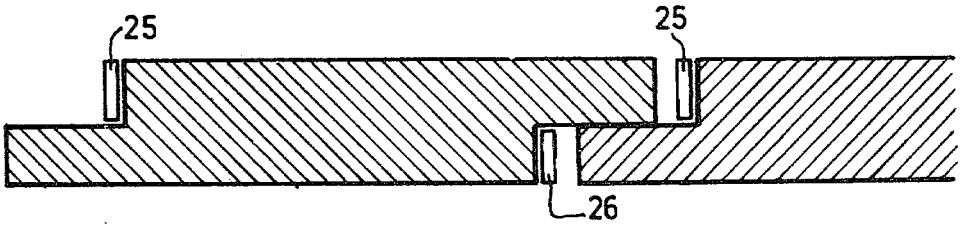
FIG. 4 is a cross-sectional view taken on line IV—IV in FIG. 3.

The stationary, second part associated with the seal assembly comprises an annular array of 70 identical connective graphite elements or plates 7. The elements or plates 7 each have an initially planar surface which rubs against the outer surface of cylindrical part 5 and quickly takes on the same curvature. The outer surface 9 of the elements or plates 7 are concave in longitudinal section whereby the array of connective elements or plates 7 formed along their outer surface define an annular groove the function of which will be described below. The contact sides of the graphite elements or plates 7 have complementary rabbets as best seen in FIG. 4 which comprise a seal against the flow of gas or air in the axial direction, even when adjacent elements or plates 7 do not bear perfectly against one another. The rabbets of each element or plate 7 are parallel to each other. The major faces of the graphite elements or plates, perpendicular to the axis of the rotary kiln, are planar.

The annular array of elements or plates 7 is held axially in place by two flat annular panels 10,11 arranged one on each side of the array of graphite elements or plates 7.

The first of these annular panels 10 is carried by the medium of an annular sleeve by a heating cap 12 which is the stationary part of the rotary kiln surrounding the nose ring 2.

The second annular panel 11 is connected to the first annular panel 10 by supports 14 of L-shape in section, which are detachable to facilitate the change of the graphite elements or plates 7 and adjustable to set the desired clamping pressure exerted by the annular panels 10 and 11 on the graphite elements or plates 7. This clamping action must be sufficient to insure the holding of the elements or plates 7 and the fluidtightness of the latter with the annular panel 10, however, it must permit radial sliding of the elements or plates 7 to compensate for the expansion or deformation of the cylindrical part 5. Each element or plate 7 is guided on one side by a lug 25 fixed to the annular panel 10 and on the other side by a lug 26 fixed to the annular panel 11, the rabbets bearing against the lugs without being blocked thereby.

A cable 15 defines an elongate flexible clamping means and describes a complete circle, passing through groove 9 formed in the outer surface 9 of the graphite elements or plates 7, the ends of the cable 15 are run over pulleys 16 and are tensioned by a counterweight 17 at one or both ends of the cable 15. Alternatively, the flexible clamping means may be tensioned by other suitable means such as spring means 17*a* or jacks 17*b*. (in dotted lines on FIG. 1).

Figure 2:
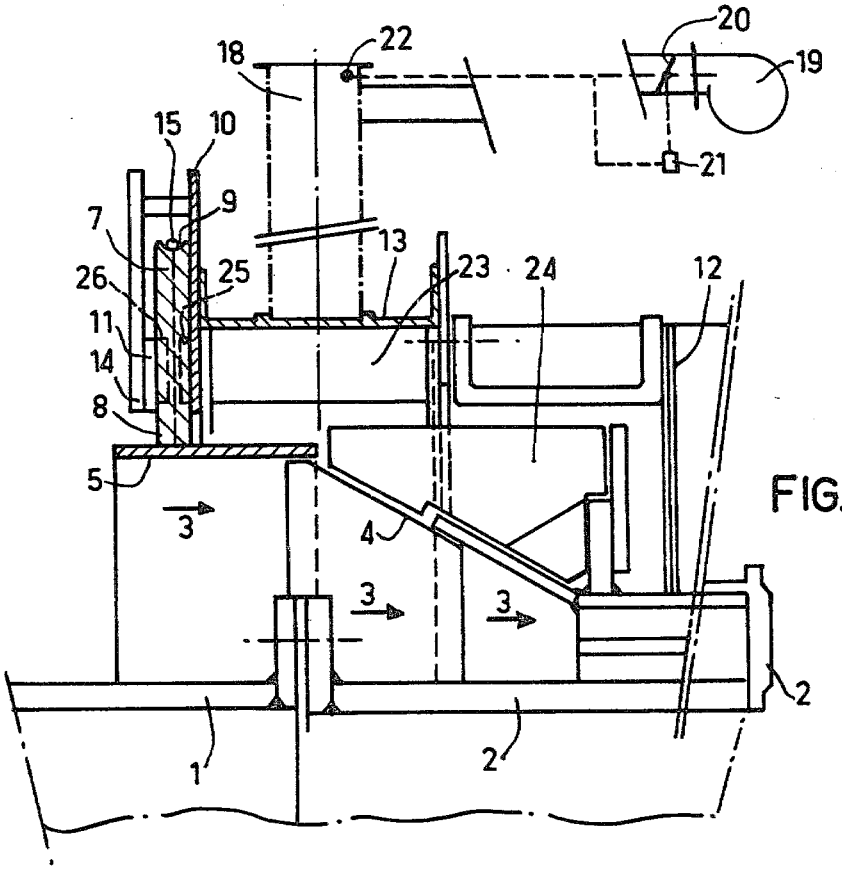
FIG. 2 shows a fragmentary sectional view taken on line II—II in FIG. 1.
Figure 3:
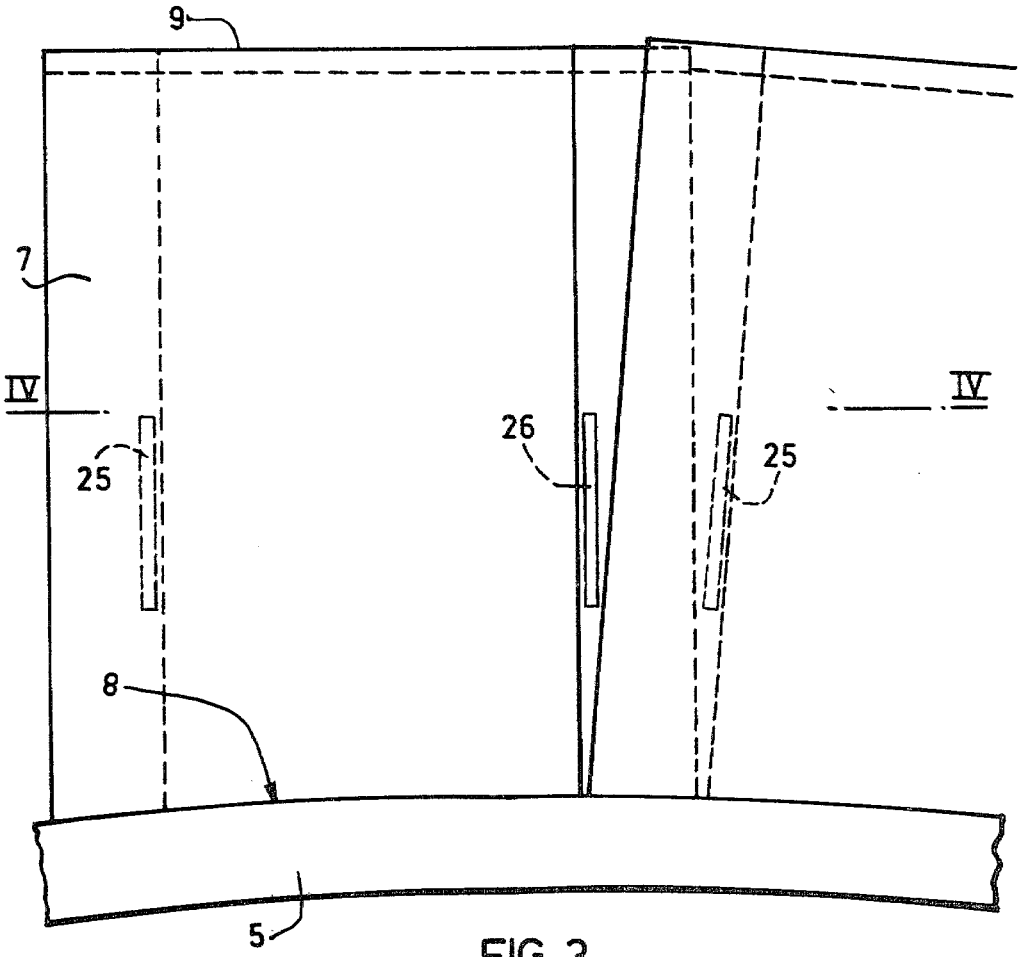
FIG. 3 shows a fragmentary view, greatly enlarged, of part of FIG. 1, with the second ring removed.

An air duct 18, shown in phantom lines in FIG. 2, traverses the upper part of the annular sleeve 13 and is connected to a blower 19 for balancing the pressure between the interior of the rotary kiln and the atmosphere. A pressure regulating flap member 20 is provided in the outlet of the blower and is controlled by electric control means 21 in response to an air temperature sensing means 22 disposed in air duct 18 proximate to the annular sleeve 13. An elevation of the sensed temperature corresponds to an outward flow of gases, and vice-versa.

Deflectors 23 and fins 24 are provided inside the annular sleeve 13 in order to limit the convection currents between the high joint and the low joint of the annular sleeve 13 and to assist settling of dust before it reaches the actual seal. Four such deflectors 23 are laterally disposed in the annular sleeve 13 (two to each side), the length of each of the deflectors 23 being slightly greater than the pitch of the fins 24.

The choice of the graphite for the elements or plates depends on the conditions of use: low density graphites are softer than high density graphites. Moreover, leaks between elements or plates 7 and between elements or plates 7 and the cylindrical part 5 are lessened; on the other hand they wear faster, especially in abrasive conditions or when there are variations in shape due to thermal stresses. Resin-impregnated graphites can, obviously, only be used if the operating temperatures of the seal are compatible with the properties of the resins. The self-lubricating qualities of graphite make the friction forces between the graphite elements or plates small and the wear of the elements or plates inconsiderable.

As the reader will have understood, the constant pressure exerted by the cable permits fluidtight contact to be maintained between the graphite elements or plates and the cylindrical part 5, despite any radial and axial displacements, owing to the relative expansibility and contractability of the annular array of graphite elements or plates 7. The expansion deformation of the cylindrical part 5 is limited by the position of this piece which affords it effective cooling.

What we claim is:

1. A seal assembly for a rotary kiln of the type having a rotating cylinder, a first part fixed for rotation with the rotating cylinder and having an outer cylindrical surface; flexible means for flexibly connecting said first part to said rotary kiln in spaced relation thereto, whereby the cylindrical geometrical form of the cylindrical surface of said first part is maintained despite deformation of said rotating cylinder; a second stationary part having a cylindrical surface approximately coaxial with the rotating cylinder and said first part and lying in spaced relation thereto; a seal assembly interposed between the first and second parts, said seal assembly comprising a liner disposed outwardly of the cylindrical surface of said first part in rubbing contact therewith and including an annular array of graphite elements in contact with one another along generally radial sides, and tensioned elongate flexible clamping means bearing against the outer surfaces of said graphite elements for clamping said graphite elements against said cylindrical surface.

2. The seal assembly according to claim 1, fins being provided on the rotating part of the kiln and deflectors on the stationary part of the kiln for limiting convection currents of hot gases and causing dust to settle before reaching the graphite elements.

3. A seal assembly according to claim 1 wherein said flexible means comprises a plurality of links mounted on the rotating cylinder.

4. A seal assembly according to claim 3 wherein a nose ring is fixed on the end of said rotary kiln, and wherein a cylindrical-conical cowling is mounted on said nose ring for flowing cooling air to said nose ring from said cylindrical-conical cowling, said cowling being sealingly but flexibly interconnected to said first part.

* * * * *